United States Patent [19]

Grantmyre

[11] 4,261,249

[45] Apr. 14, 1981

[54] HAMMER

[75] Inventor: Innes Grantmyre, Cambridge, Canada

[73] Assignee: Joy Manufacturing Company, Pittsburgh, Pa.

[21] Appl. No.: 940,804

[22] Filed: Sep. 8, 1978

[51] Int. Cl.[3] ..... F15B 13/042

[52] U.S. Cl. ..... 91/461; 91/418; 173/138

[58] Field of Search ..... 91/440, 436, 418, 461; 251/52, 47, 51; 173/138, 135

[56] References Cited

U.S. PATENT DOCUMENTS

| | | | |
|---|---|---|---|
| Re. 27,244 | 12/1971 | Voitsekhovsky . | |
| 1,935,299 | 11/1933 | Siegert | 251/52 |
| 2,703,705 | 3/1955 | Boller | 251/51 X |
| 3,079,900 | 3/1963 | Hunnicutt . | |
| 3,732,936 | 5/1973 | Sudnishnikov et al. | 173/137 |
| 3,735,823 | 5/1973 | Terada | 173/119 |
| 3,817,154 | 6/1974 | Martin | 91/420 |
| 3,872,934 | 3/1975 | Terada | 173/134 |
| 3,916,768 | 11/1975 | Martin | 91/436 X |
| 4,012,909 | 3/1977 | Hibbard | 60/371 |
| 4,150,603 | 4/1979 | Etherington et al. | 60/371 X |

FOREIGN PATENT DOCUMENTS

| | | | |
|---|---|---|---|
| 288392 | 4/1928 | United Kingdom | 251/52 |

*Primary Examiner*—Irwin C. Cohen

*Attorney, Agent, or Firm*—J. Stewart Brams

[57] ABSTRACT

A fluid operable hammer including variable volume exhaust chamber means for receiving motive fluid and improved motive fluid inlet and exhaust valve means cooperable with the exhaust chamber means.

8 Claims, 2 Drawing Figures

Figure 1:
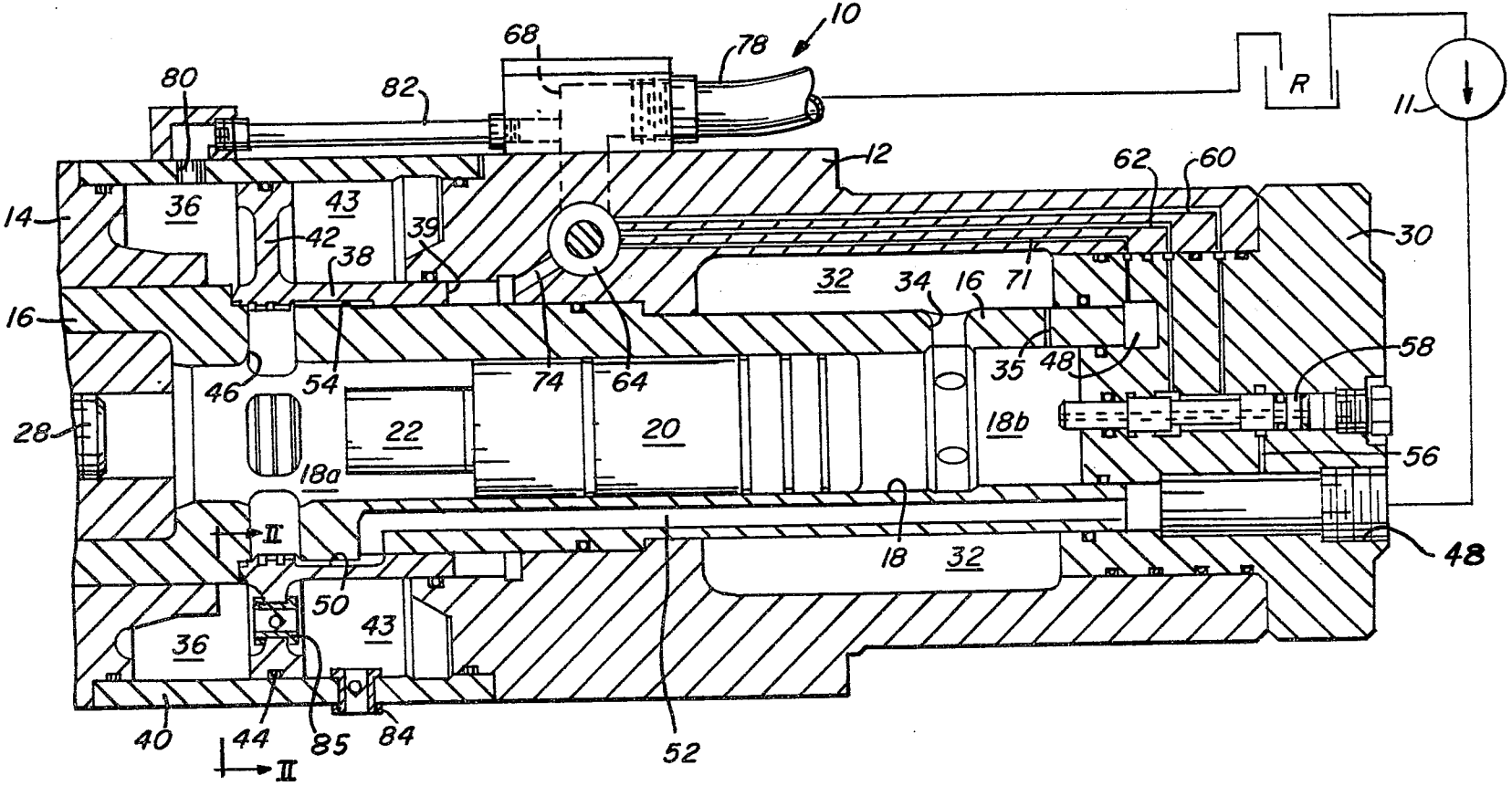

10
11
12
14
16
18
18a
18b
20
22
28
30
32
34
35
36
38
39
40
42
43
44
46
48
50
52
54
56
58
60
62
64
68
71
74
78
80
82
84
85
R
II

HAMMER

In the art of fluid operable hammers or impactors it is known to provide fluid power means for reciprocably cycling a hammer piston within an elongated bore to produce repetitive impacts on a working member. For example in U.S. Patent 4,012,909 there is described an impactor including a gas charged fluid accumulator which provides motive gas pressure within a rearward portion of an elongated bore to act continuously on one end of a hammer piston axially movably disposed within the bore. A hydraulic fluid pressure means alternately applies motive fluid pressure within a forward portion of the bore to act on the opposite end of the hammer piston to upstroke the piston against the continuously applied accumulator pressure. The hydraulic fluid pressure is then released to exhaust and the hammer piston is driven by the applied accumulator pressure through the bore in a downstroke or power stroke to impact upon a working member such as a striking bar.

In order to minimize hydraulic fluid exhaust back pressure which may impede hammer piston movement through the power stroke and thereby reduce the available impact energy, some impactors have been provided with an exhaust fluid receiving means including an exhaust chamber located so as to communicate directly with the forward bore portion in open, substantially unrestricted fluid flow relation during the piston power stroke to facilitate the exhausting of hydraulic fluid from the bore. However, in many prior impactors the exhaust chamber would tend to remain full of hydraulic fluid and the desired exhaust back pressure reduction would not be achieved. Therefore, some such impactors have also included an external suction pump associated with the exhaust chamber to drain at least some of the hydraulic fluid therefrom prior to each piston power stroke thus providing an empty volume within the chamber to receive the hydraulic fluid to be exhausted during the subsequent piston power stroke. Additionally, the location of the exhaust chamber fluid outlet port, which communicates either with the suction pump or directly with the fluid reservoir, has limited the available operating positions or orientations of some prior impactors inasmuch as the outlet port must be in continuous fluid flow communication with the fluid within the exhaust chamber to permit exhausting thereof to the reservoir. Thus, desirable as such exhaust fluid receiving means have been in the prior art their inclusion has often increased the cost and design complexity of the impactor or unduly limited its utility.

In copending U.S. patent application Ser. No. 830,557, which was filed on Sept. 6, 1977, and is assigned to the same assignee as is the instant invention, there is described an impactor having improved exhaust fluid receiving means including a main exhaust valve which selectively controls fluid communication between the forward end portion of a hammer piston and a variable volume exhaust chamber. Also described in the cited application is the manner in which the exhaust chamber cooperates with the main exhaust valve to provide a pumping action for pumping hydraulic fluid out of the exhaust chamber prior to each power stroke of the piston regardless of the physical orientation of the impactor.

The present invention contemplates improvements to motive fluid exhaust means in impactors of the type hereinabove specified through the inclusion therein of novel means for the venting of variable volume spaces associated with operation of a main exhaust valve whereby the exhaust valve may be operated with a minimum of energy waste and in a manner to reduce leakage of hydraulic fluid to the environment. A preferred embodiment of the invention provides for inertially operated or fluid pressure operated one-way valve means to be utilized for selective fluid communication with the spaces to be vented. The venting of such spaces according to the present invention not only eliminates fluid pressure which would otherwise waste hammer piston power stroke energy, but in addition provides for the return to the hydraulic system of fluid which has leaked into such spaces without resort to additional external drain lines, scavenger pumps or other such attachments. As used herein the word fluid is intended generally to denote either liquid or gas, except in those instances where context clearly denotes one or the other.

Figure 2:
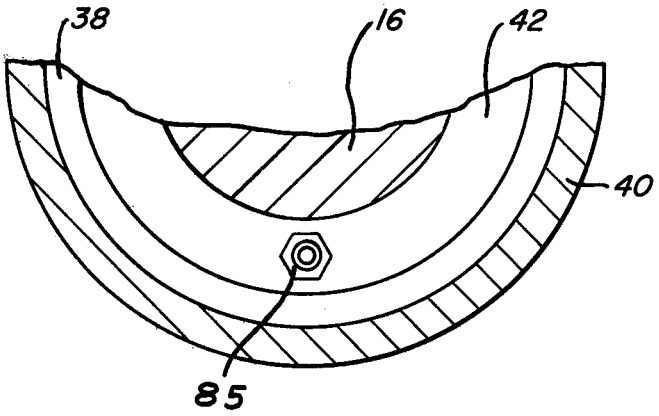

These and other objects and advantages of the instant invention are more fully specified in the following description with reference to the accompanying figures in which:

FIG. 1 is a longitudinal section of a portion of an impactor showing vent means according to one embodiment of the instant invention; and FIG. 2 is a fragmentary cross sectional view taken on line 2—2 of FIG. 1.

There is generally indicated at 10 in FIG. 1 a rearward end portion of a fluid operable impactor or hammer constructed according to one embodiment of the instant invention. Impactor 10 comprises a generally annular, elongated rear body portion 12 coaxially aligned with a generally annular, elongated forward body portion 14. A main cylinder member 16 extends coaxially within body portions 12 and 14 and includes a stepped coaxial through bore 18 within which is axially reciprocably carried an elongated hammer piston 20. Piston 20 divides bore 18 into forward and rearward variable volume bore portions or working chambers **18*a*, 18*b*, respectively. An elongated, coaxial piston stem portion 22 extends forwardly of piston 20 and is adapted to repeatedly impact on a striking bar 28 carried by body portion 14 upon axial reciprocation of piston 20 within bore 18 as is well known. In FIG. 1 piston 20** is shown at an intermediate position between the impact position and the full upstroke position, which positions are, respectively, to the left and right of the illustrated intermediate position.

A backhead member 30 rigidly, sealingly engages the axially rearward ends of body portion 12 and cylinder 16 for sealed closure of working chamber **18*b* and to define, in conjunction with body portion 12 and cylinder 16, generally annular, elongated gas accumulator space 32. A plurality of circumferentially spaced bores 34 extend radially through cylinder 16 to provide fluid communication between accumulator space 32 and bore portion 18*b*. In practice the space comprised of bore portion 18*b*, accumulator space 32 and interconnecting bores 34 is charged with a motive fluid under pressure, for example nitrogen at approximately 1200 psi, which acts on the rearward end of piston 20 to continuously urge the piston 20 forward toward striking bar 28**.

For reciprocation of piston 20 a pressure fluid such as hydraulic fluid is alternately applied to the forward end of piston 20 to move piston 20 toward its rearward or upstroke position against the bias of the pressurized gas within accumulator 32 thus further charging the accumulator. After each such piston upstroke the applied hydraulic fluid pressure is relieved to exhaust and, after a suitable time delay, the bias of the accumulator gas pressure is fully applied to drive piston 20 to impact on striking bar 28. To provide the alternate supplying and release of hydraulic fluid pressure to the forward end of piston 20 a generally annular elongated sleeve valve 38 is disposed in circumferentially surrounding, axially slidable relationship with an intermediate portion of cylinder member 16 for opening and closing a plurality of circumferentially spaced fluid exhaust ports 46 which radially penetrate cylinder 16 to provide fluid communication between working chamber 18*a* and a generally annular variable volume, exhaust fluid receiving chamber 36 defined radially outwardly adjacent thereto. A generally annular elongated shell member 40 coaxially sealingly surrounds and extends between the respective adjacent ends of body portions 12 and 14 to define the outermost periphery of chamber 36.

A radially outwardly extending member 42 is connected to valve 38 (preferably a radially and circumferentially extending flange portion thereof) and the radially outermost extent thereof slidably, sealingly engages the inner wall of shell 40 as indicated at 44 to define a movable longitudinal end wall of exhaust chamber 36. In FIG. 1 valve 38 is shown at one extreme position thereof whereat ports 46 are fully closed and the volume of exhaust chamber 36 is a minimum. In the opposite extreme position thereof, valve 38 is moved to the right with respect to the position illustrated in FIG. 1 such that ports 46 are fully open to provide open fluid communication between chamber 36 and bore portion 18*a*, and the volume of exhaust chamber 36 is at a maximum.

Flange 42 cooperates with the elements forming the stationary boundaries of chamber 36, namely shell 40, body portion 14 and cylinder 16, to provide a piston and cylinder means whose maximum displacement preferably is substantially no less than the maximum displacement of piston 20 within bore portion 18*a* (i.e., no less than the total volume swept by the forward end of piston 20 in moving from its full upstroke position to impact). Accordingly, the maximum displacement volume of flange 42 within exhaust chamber 36 is sufficient to receive substantially all of the hydraulic fluid exhausted from bore portion 18*a* during a single piston impact stroke. Ideally, the maximum volume of exhaust chamber 36 is preferred to be somewhat larger than the displacement of flange 42 therewithin. That is, it is desirable that the minimum volume of chamber 36, as shown in FIG. 1, not be nil or substantially nil. For example, chamber 36 may have a minimum volume approximately equal to or perhaps greater than the maximum available displacement of flange 42.

In another acceptable though less preferable embodiment the minimum volume of chamber 36 might be so chosen that the sum of such minimum volume and the full displacement of flange 42 is only slightly greater than the full displacement of piston 20 within bore portion 18*a*. Furthermore, a suitable time delay is provided between the initial opening of valve 38 and the firing of piston 20 by a delay in the full application of accumulator gas pressure to piston 20 whereby the hydraulic fluid ejected from bore portion 18*a* through exhaust ports 46 encounters a minimal back pressure inasmuch as valve 38 is substantially fully open before the firing of piston 20.

An exhaust port 80 is formed in shell 40 to provide fluid flow communication between chamber 36 and a fluid reservoir R by way of, as shown, a succession of communicating conduit means including a conduit 82 a port 68 and a conduit 78. A space 43 is defined within shell 40 on the opposite side of flange 42 from chamber 36 to accommodate the axial movement of flange portion 42 which occurs in conjunction with the axial movement of valve 38 to open and close ports 46.

As shown, means for operation of impactor 10 include a main hydraulic fluid inlet 48 which provides for connection to impactor 10 of an external pressure fluid flow source such as a suitable pump 11. Inlet 48 communicates in continuous, open fluid communication with an inner, circumferentially extending undercut portion 50 of sleeve valve 38 via an axially extending fluid flow passageway means 52 formed in cylinder 16. The internal diameter of sleeve valve 38 forwardly of undercut portion 50 is larger than the internal diameter thereof rearwardly of undercut 50 and a cooperating step 54 is formed between the outer diameters of the respective peripheral portions of cylinder 16 upon which sleeve valve 38 slides. Accordingly, a differential area piston is defined between the axial ends of undercut 50, and the pressure of the hydraulic fluid directed into undercut 50 thus exerts a continuous, rearwardly directed net force on sleeve valve 38 which urges the valve toward its rearward or open position. Hydraulic pressure fluid is also provided from inlet 48 via suitable fluid flow passageway means 56 to a suitable trigger valve means 58 shown as being carried by backhead 30, and passageway means such as at 60, 62 are provided to communicate in fluid flow conducting relation between valve 58 and an actuator valve means 64 whereby actuator valve 64 is selectively controlled to alternately supply pressure fluid from any suitable source of fluid flow to an annular, rearward end surface portion 39 of valve 38 to overcome the bias of pressure fluid within undercut 50 and urge valve 38 forwardly toward its closed position. The reader is referred to the above mentioned copending application Ser. No. 830,557 for a complete and detailed description of the manner in which valves 38, 64 and 58 provide for self actuated reciprocation of piston 20 when hydraulic pressure fluid flow is provided as indicated. Specifically, the entire content of pages 7 through 10 inclusive of the description of the referenced copending application are incorporated herein and made a part hereof by reference.

For purposes of the present invention, it will suffice to note that, irrespective of the manner in which valve 38 is actuated in conjunction with the reciprocation of piston 20, it is preferred that the variable volume space 43 be vented to provide for reciprocation of the valve 38 without any undue waste of energy. A vent means is proposed in the cited copending patent application; however, it is believed the present invention offers novel and superior means of venting for space 43 which not only will provide suitable venting characteristics but in addition will help to control the hydraulic fluid leakage into space 43, and specifically will limit dispersion into the atmosphere of any such hydraulic fluid leakage. Accordingly, as shown, space 43 is provided with one vent means in the form of one or more valve means 85 which longitudinally penetrates flange 42 to communicate in fluid flow relation between chambers 36 and 43. Check valve 85 may be an inertially or pressure operated one-way check valve such as the schematically illustrated ball check valve element which provides for fluid flow only from chamber 43 into chamber 36 and blocks fluid flow in the reverse direction. In addition, there may be provided a valve means 84 similar to valve 85 which radially penetrates shell 40 and includes, for example, a suitable inertial or fluid pressure operated one-way check valve element such that only fluid flow into space 43 from the exterior environment is permitted by valve 84 inasmuch as any pressure within chamber 43 which is higher than the ambient atmospheric pressure will cause valve 84 to close. Of course valve 84 is so located that it does not interfere with the longitudinal movement of the flange 42.

It will be seen that the check valves 84 and 85 described hereinabove provide for suitable venting of space 43 at any time during the cycling of valve 38 whether the valve movement be increasing or decreasing the volume of chamber 43. Accordingly, as valve 38 moves to the right from its fully closed position as illustrated in FIG. 1, any fluid pressure greater than the ambient atmospheric pressure that develops as a result of the decreasing volume of space 43 will cause valve 84 to close and thus the contained pressure will of necessity be relieved through valve 85 into space 36. It is to be noted that during the rightward motion of valve 38 ports 46 are opening and highly pressurized fluid from bore portion 18*a* is being received into space 36; however, inasmuch as the hydraulic fluid is not highly compressible the pressure thereof within space 36 will be negligible. This, coupled with the hereinabove mentioned time delay in the firing of piston 20 and the fact that space 36 is drained via port 80 to the reservoir R, jointly serve to preclude any increase of fluid pressure in chamber 36 during opening of valve 38 over the pressure levels developed within space 43. Thus, while in theory valve 85 might be open or closed during opening of valve 38 depending upon the relative magnitudes of fluid pressures in chambers 36 and 43, it is believed the valve 85 will in fact be open substantially throughout the opening of valve 38 to vent space 43 into chamber 36.

During the closing of valve 38, the movement of flange 42 to the left decreases the volume of space 36 and increases that of space 43 as ports 46 are being closed and hydraulic fluid is pumped out of space 36 by the advancing flange 42. The resulting fluid pressure developed within space 36 and the relative rarification of fluid pressure within space 43, tends to close valve 85 and, when the pressure in space 43 decreases below the ambient pressure, valve 84 will be opened.

It will be appreciated that check valve 84 to the atmosphere may be excluded from the venting arrangement for space 43 if desired, in which case a partial vacuum will be drawn in space 43 during closing of main valve 38. This is not considered a critical matter inasmuch as the closing of main valve 38 is a relatively long portion of the impactor operating cycle. In addition, such partial vacuum, if maintained, may increase the rate of the subsequent exhaust valve opening, which is highly desirable. If check valve 84 is included as described the operation of valve 38 will be neither impeded nor enhanced by gas or fluid pressure within space 43.

At all times during reciprocation of sleeve valve 38 to open and close ports 46, space 43 is vented such that the development of fluid pressure therein is avoided without recourse to a direct vent open to the atmosphere which could lead to environmentally undesirable fluid dispersion into the atmosphere. More specifically, in the event of minor hydraulic fluid leakage past seal 44 or past other seals into space 43, the closing of check valve 84 during the opening of sleeve valve 38 assures that any such fluid leakage will not be expelled from space 43 to the atmosphere. Instead, the fluid turbulance within space 43 induced by the rapid opening valve 38 will tend to atomize such hydraulic fluid leakage within space 43 and a portion of this entrained hydraulic fluid will pass from space 43 to space 36 through valve 85 during the opening of valve 38. During closing of valve 38, with the volume of space 43 expanding, any fluid within space 43 will remain therewithin inasmuch as valve 85 is closed and valve 84 will open only to air flow into space 43 from the atmosphere.

According to the description hereinabove, there is provided by the present invention an improved exhaust means for a hydraulic fluid circuit in a fluid operable impactor assembly whereby check valve means is associated with a variable volume space to provide for venting of such variable volume space to the benefit of overall impactor operation. Specifically, the check valve means provides for venting of such variable volume space without leakage of fluid within the variable volume space to the ambient atmosphere. One vent arrangement described hereinabove provides for inflow of air from the ambient atmosphere to such variable volumes space and vents the variable volume space into a motive fluid exhaust chamber used for exhausting hydraulic flow from the impactor assembly. In addition the vent arrangement provides for the return of hydraulic fluid within the variable volume space to the hydraulic system of the impactor and precludes its dispersion into the atmosphere.

Inasmuch as the description hereinabove pertains to certain preferred embodiments of the invention, it is to be appreciated that various modifications and alternate embodiments are envisioned which are within the spirit and scope of the invention described. For example, the check valve assemblies 84 and 85 may be any suitable known or heretofore unknown check valves so long as they function according to the description hereinabove. Vent 84 may be vented to the reservoir R at substantially ambient pressure rather than to the atmosphere, in which case a continuously open vent may be substituted for valve 84. Furthermore, valve 85 need not be installed in flange 42, but may alternatively be installed in any suitable flow path communicating between spaces 43 and 36, for example in an external conduit which penetrates shell 40 to communicate with spaces 43,36. In addition the operating cycle of hammer piston 20 may be broadly varied within the limits of the invention described, as may be the control means, motive fluids, and modes of control utilized to reciprocate the hammer piston. Specifically in this regard, the fluid used in accumulator 32 may be either a gas or a liquid. These and other embodiments and modifications having been envisioned and anticipated by the inventor, it is respectfully submitted that this invention should be interpreted as broadly permitted by the scope of the claims appended hereto.

What is claimed is:

1. In an impactor apparatus including an axially reciprocable free piston and motive fluid supply means for reciprocating said piston through alternate work strokes and return strokes, the improvement comprising:

a working chamber defined within said apparatus in conjunction with said free piston and adapted to receive therein motive fluid from said motive fluid supply means for propelling said piston through a return stroke; at least one exhaust port for communicating in fluid flow relation with said working chamber to selectively release motive fluid from said working chamber to permit said free piston to be propelled through a work stroke; exhaust valve means cooperable with said exhaust port to selectively open and close said exhaust port; moveable means cooperable with said exhaust valve means and with other portions of said apparatus to define a pair of variable volume chambers; one of said variable volume chambers being maintained in selective fluid flow communication with said working chamber to receive motive fluid from said working chamber when said exhaust port is open; and vent means at least partially carried by said moveable means and communicating in fluid flow relation between said one variable volume chamber and the ambient atmosphere through the other of said variable volume chambers and cooperable with said moveable means in a manner to ventilate said one variable volume chamber by fluid flow from said other of said variable volume chambers during opening of said exhaust port by said exhaust valve means while precluding discharge of motive fluid through said vent means to the ambient atmosphere and precluding fluid flow between said variable volume chambers during closing of said exhaust port by said exhaust valve means while providing fluid flow from the ambient atmosphere to said other of said variable volume chambers.

2. The improvement as claimed in claim 1 wherein said exhaust valve means is moveable to open and close said exhaust port and said moveable means is moveable in conjunction with said opening and closing of said exhaust port.

3. The improvement as claimed in claim 2 wherein said moveable means includes a portion of said exhaust valve means.

4. The improvement as claimed in claim 3 wherein said exhaust valve means includes a generally annular valve body and said moveable means includes a radially projecting flange portion of said annular body.

5. The improvement as claimed in claim 4 wherein said vent means includes at least one valve element carried by said moveable means.

6. The improvement as claimed in claim 1 wherein said vent means includes at least one one-way check valve element carried by said moveable means.

7. The improvement as claimed in claim 5 wherein said vent means includes a second valve element communicating between said other variable volume chamber and the ambient atmosphere.

8. The improvement as claimed in claim 7 wherein said vent means includes a pair of one-way check valve elements.

* * * * *